United States Patent [19]

Monkelbaan et al.

[11] Patent Number: 4,731,631

[45] Date of Patent: Mar. 15, 1988

[54] VERTICALLY ORIENTED PHOTOCONDUCTIVE DRUM

[75] Inventors: Edwin R. Monkelbaan, Fairport; Joseph Fantuzzo, Webster, both of N.Y.

[73] Assignee: Xerox Corporation, Stamford, Conn.

[21] Appl. No.: 40,424

[22] Filed: Apr. 20, 1987

[51] Int. Cl.[4] ..... G03G 15/00; G03G 15/10; G03G 21/00; G03G 15/06

[52] U.S. Cl. ..... 355/3 DR; 118/652; 355/3 R; 355/10; 355/15

[58] Field of Search ..... 355/3 DR, 3 R, 3 DD, 355/10, 15; 118/652, 660

[56] References Cited

U.S. PATENT DOCUMENTS

| | | | |
|---|---|---|---|
| 3,168,021 | 2/1965 | Levene | 95/1.7 |
| 3,683,852 | 8/1972 | Yamaguchi et al. | 118/637 |
| 4,165,172 | 8/1979 | Okamoto et al. | 355/15 |
| 4,285,115 | 3/1981 | Magome et al. | 118/652 |
| 4,373,469 | 2/1983 | Kuge et al. | 118/652 |
| 4,591,543 | 5/1986 | Outsuka et al. | 118/652 X |
| 4,622,915 | 11/1986 | Outsuka et al. | 118/652 |

*Primary Examiner*—Arthur T. Grimley
*Assistant Examiner*—Ed Pipala
*Attorney, Agent, or Firm*—H. Fleischer; J. E. Beck; R. Zibelli

[57] ABSTRACT

A printing machine including a drum adapted to have a latent image recorded on the surface thereof. The drum is positioned with the longitudinal axis thereof extending in a direction substantially transverse to the horizontal. The latent image is developed with a liquid developer to form a liquid image on the surface of the drum. The liquid image is transferred to a copy sheet. Residual liquid developer removed from the surface of the drum by the cleaning unit, flows in a downwardly direction under the influence of gravity to a liquid collector housing located at the bottom of the cleaning unit.

10 Claims, 2 Drawing Figures

VERTICALLY ORIENTED PHOTOCONDUCTIVE DRUM

Figure 1:
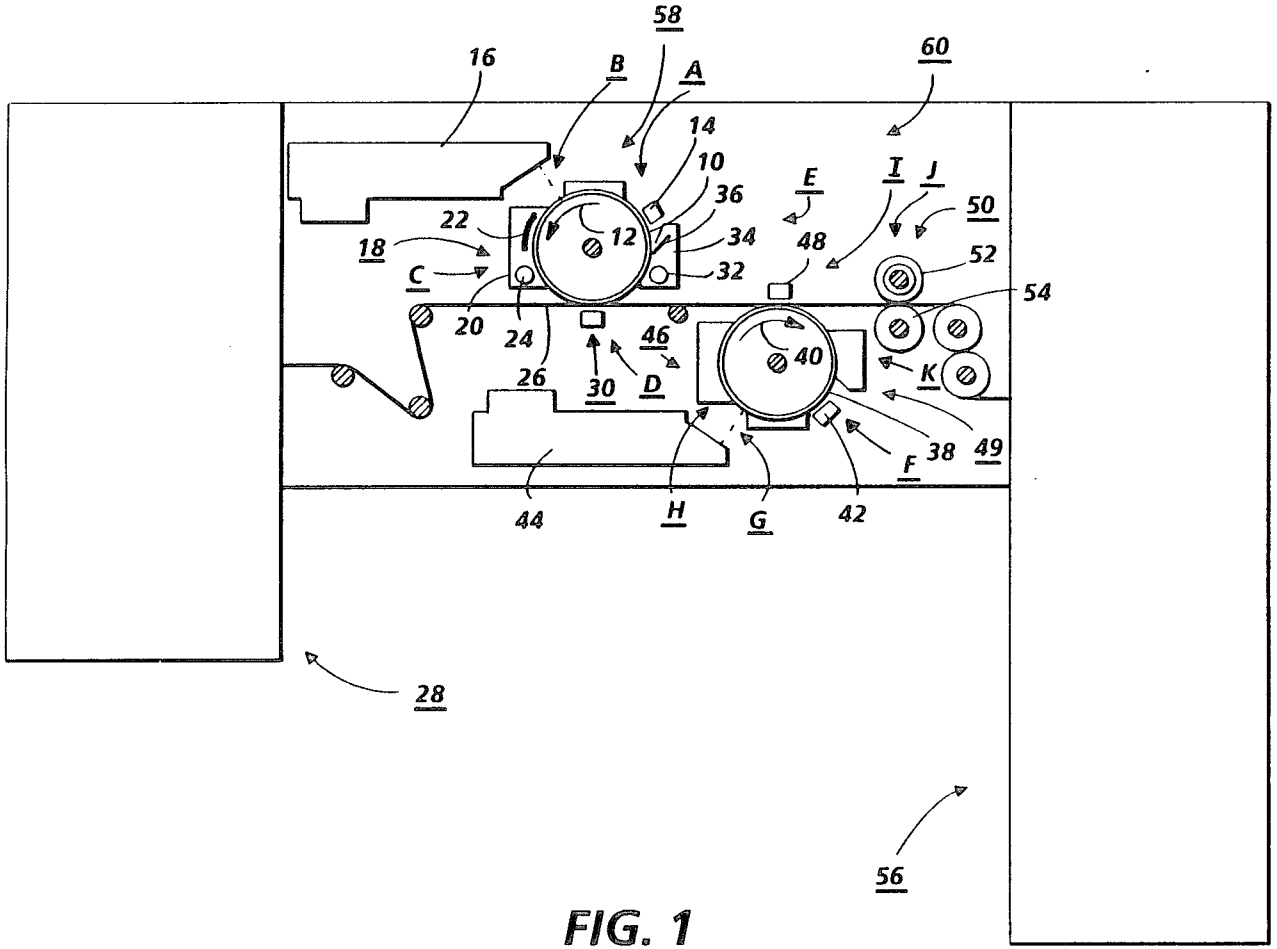

This invention relates generally to an electrophotographic printing machine, and more particularly concerns a printing machine using a liquid developer having the various processing stations and photoconductive drum oriented with their longitudinal axes substantially perpendicular to the horizontal.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles are deposited, in image configuration, on the photoconductive member. Thereafter, the developed image is transferred to the copy sheet. Heat is applied to the copy sheet to permanently fuse the pigmented particles to the copy sheet and vaporize the residual liquid carrier adhering thereto.

Hereinbefore, a drum having a photoconductive surface was frequently employed as the photoconductive member. The photoconductive drum and the processing stations associated therewith were generally positioned with their longitudinal axes substantially horizontal. With the advent of liquid developer materials, the architecture of the electrophotographic printing machine became constrained. For example, a liquid development system does not operate reliably above the horizontal diagonal of the photoconductive drum. This imposes a severe constraint on the printing machine architecture. In contradistinction, a printing machine employing a liquid developer offers the opportunity to utilize alternate machine configurations relative to printing machines using dry developer materials. A printing machine employing a vertically positioned photoconductive drum may offer some advantages over a printing machine having a horizontally positioned photoconductive drum. By way of example, a printing machine having a vertically oriented photoconductive drum offers more flexibility as to where to place the development and cleaning systems. Furthermore, the sealing of the development and cleaning systems may be easier to design. Gravity aids in the flow of the liquid developer and liquid handling systems need be only located at the bottom of the printing machine. Moreover, machine vibration may be easier to control by using a vertical rather than horizontal mount system. A printing machine employing both a vertically oriented drum and vertically oriented processing stations may, therefore, be more reliable. The following disclosures appear to be relevant:

- U.S. Pat. No. 3,168,021, Patentee: Levene, Issued: Feb. 2, 1965.
- U.S. Pat. No. 3,683,852, Patentee: Yamaguchi et al., Issued: Aug. 15, 1972.
- U.S. Pat. No. 4,165,172, Patentee: Okamoto et al., Issued: Aug. 21, 1979.

The pertinent portions of the foregoing disclosures may be briefly summarized as follows:

Levene discloses an electrostatic printing apparatus which employs a vertically mounted continuous web as a recording element. A vertically disposed tubular member supplies liquid developer to the web for image development. Unused developer drains from the recording element and is collected in a sump so that it may be used again.

Yamaguchi et al. teaches an apparatus for developing an electrophotographic film having an electrostatic latent image recorded thereon. A vertically disposed supporting device holds the film in a developing chamber. A liquid developer is introduced into the chamber to develop the latent image.

Okamoto et al describes a cleaning system for an electrophotographic recording apparatus. A spongy roller is positioned in pressing engagement with the surface of a horizontally disposed photoconductive drum. A resilient blade also contacts the drum downstream of the roller. A cleaning liquid is supplied into the space between the roller and the blade to help clean residual toner from the drum.

In accordance with one aspect of the present invention, there is provided a printing machine including a drum adapted to have a latent image recorded on the surface thereof. The drum is positioned with the longitudinal axis thereof extending in a direction substantially transverse to the horizontal. Means develop the latent image with a liquid developer to form a liquid image on the surface of the drum. Means are provided for transferring the liquid image from the surface of the drum to a copy sheet. Means clean the residual liquid developer from the surface of the drum. The cleaning means is positioned so that the residual liquid developer removed from the surface of the drum flows in a downwardly direction under the influence of gravity.

Figure 2:
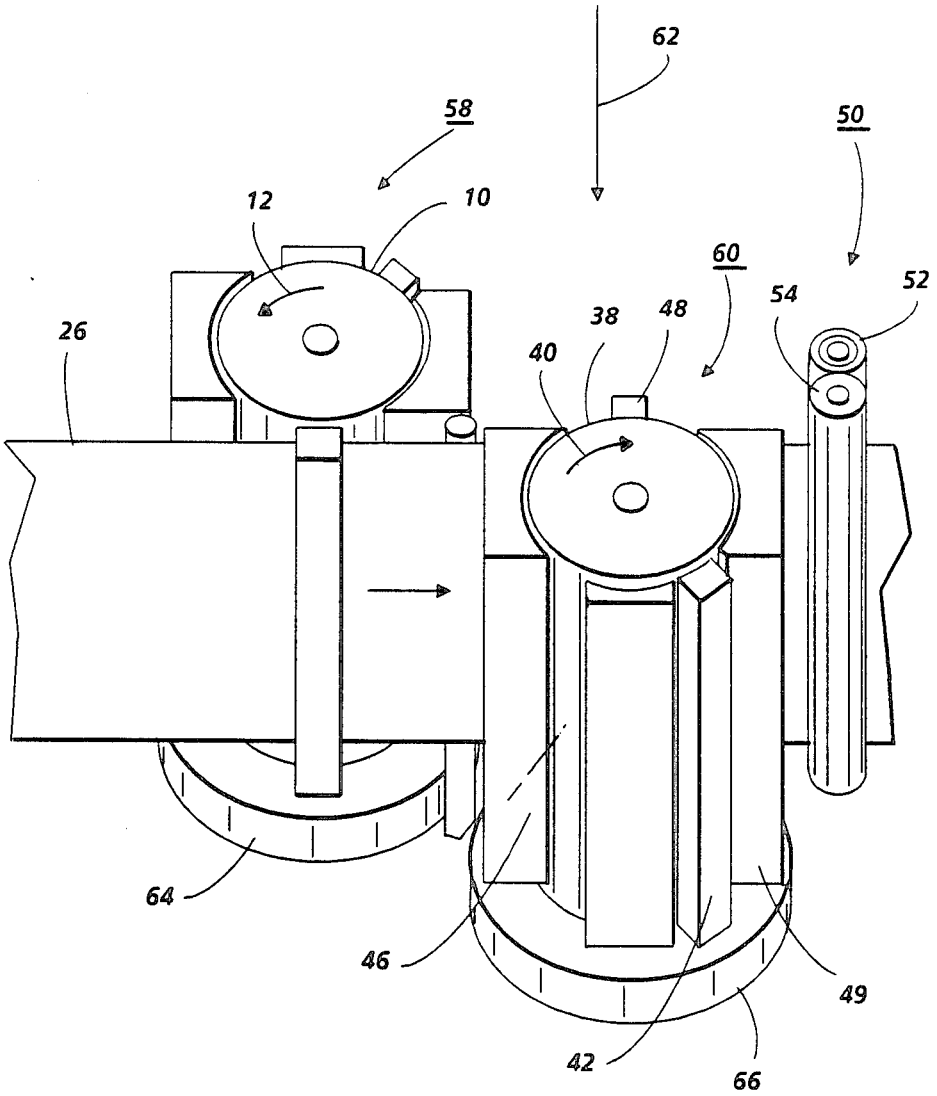

Other aspects of the present invention will become apparent as the following description proceeds and upon reference to the drawings, in which:

FIG. 1 is a schematic plan view showing an illustrative electrophotographic printing machine incorporating the features of the present invention therein; and FIG. 2 is a fragmentary, perspective view of the FIG. 1 printing machine.

While the present invention will hereinafter be described in conjunction with a preferred embodiment thereof, it will be understood that it is not intended to limit the invention to this embodiment. On the contrary, it is intended to cover all alternatives, modifications, and equivalents as may be included within the spirit and scope of the invention as defined by the appended claims.

Turning now to FIG. 1, a top or plan view of the electrophotographic printing machine is shown thereat. The electrophotographic printing machine includes two processing units, indicated generally by the reference numerals 58 and 60, for forming liquid images on opposed sides of a web or copy paper. Processing unit 58 employs a vertically oriented drum 10 having a photoconductive surface deposited on a conductive substrate extending about the circumferential surface thereof. Preferably, the photoconductive surface is made from a selenium alloy with the conductive substrate being made from an electrically grounded aluminum alloy. Other suitable photoconductive surfaces and conductive substrates may also be employed. Drum 10 is positioned with its longitudinal axis substantially perpendicular to the horizontal. Thus, the longitudinal axis of drum 10 extends in a direction substantially parallel to the direction of gravity. Drum 10 rotates in the direction of arrow 12 to advance successive portions of the photoconductive surface through the various processing stations disposed about the path of movement thereof. Drum 10 is supported by ball bearings located at the upper and lower ends of its support shaft. A suitable motor associated with a drive is coupled to drum 10 to rotate drum 10 in the direction of arrow 12.

Initially, a portion of the photoconductive surface of drum 10 passes through charging station A. At charging station A, a corona generating device, indicated generally by the reference numeral 14, charges the photoconductive surface of drum 10 to a relatively high, substantially uniform potential. Corona generating device 14 includes a coronode wire and a shield. Both the wire and the shield extend in a direction substantially perpendicular to the horizontal.

Next, the charged portion of the photoconductive surface is advanced through exposure station B. At exposure station B, a raster output scanner 16 lays out an image in a series of vertical scan lines with each line having a specified number of pixels per inch. The raster output scanner 16 includes a laser with a rotating polygon mirror to selectively illuminate the charged portion of the photoconductive surface of drum 10 to record an electrostatic latent image thereon. Thereafter, drum 10 advances the electrostatic latent image recorded on the photoconductive surface of drum 10 to development station C.

At development station C, a developer unit, indicated generally by the reference numeral 18, has a developing liquid comprising a clear insulating carrier liquid and pigmented particles, i.e. black toner particles, stored therein. The developing liquid contacts the electrostatic latent image to form a liquid image on the photoconductive surface of drum 10. A suitable clear insulating liquid carrier may be made from an aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Developer unit 18 is mounted on the frame of the printing machine. The developing liquid is circulated by a pump from a container through a pipe into development tray 20 from which it is withdrawn through a pipe for recirculation. Tray 20 is elongated and mounted in a vertical orientation on the frame of the printing machine. The longitudinal axis of tray 20 is substantially perpendicular to the horizontal and substantially parallel to the longitudinal axis of drum 10. When liquid developer material is being circulated, the liquid developer material enters tray 20 in the uppermost region thereof and flows in a downwardly direction, under the influence of gravity, to the lowermost region of tray 20 for collection thereat Development electrode 22, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particle is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller 24, whose surface moves in a direction opposite to the direction of movement of the photoconductive surface, is spaced from the photoconductive surface and adapted to shear excessive liquid from the developed image without disturbing the image.

After development, drum 10 advances the liquid image developed on the photoconductive surface thereof to transfer station D. A continuous web of support material 26, i.e. a web of copy paper, is advanced from a supply housing, indicated generally by the reference numeral 28., to transfer station D. Transfer station D includes a corona generating device, indicated generally by the reference numeral 30. Corona generating device 30 includes an elongated shield and a coronode wire. Both the wire and shield extend in a direction substantially perpendicular to the horizontal and substantially parallel to the longitudinal axis of drum 10. Corona generating device 30 sprays ions onto the backside of the web of copy paper 26 to attract the developed image thereto. In this way, a liquid image is formed on one side of the web of copy paper 26. Thereafter, the web of copy paper 26 advances to the transfer station associated with processing unit 58 to have a liquid image transferred to the other side thereof.

Invariably, after transfer, some residual liquid developer material remains adhering to the photoconductive surface of drum 10. This residual developer material is removed from the photoconductive surface at cleaning station E. Cleaning station E includes a cleaning roller mounted rotatably in housing 34. Roller 32 is made from a polyurethane material, i.e. a foam, and driven in a direction opposite to the direction of rotation of drum 10 so as to scrub the photoconductive surface clean. A cleaning blade 36 comprises the cleaning of the photoconductive surface To assist in this action, liquid carrier may be fed through a pipe onto the free edge of the cleaning blade engaging to the photoconductive surface of drum 10. Roller 32 is positioned so that the longitudinal axis thereof is substantially perpendicular to the horizontal and substantially parallel to the longitudinal axis of drum 10. Similarly, the free edge of blade 36, which contacts the photoconductive surface of drum 10, extends in a direction substantially perpendicular to the horizontal and substantially parallel to the longitudinal axis of drum 10. In this way cleaning fluid, i.e. liquid carrier, may be introduced at the uppermost region of housing 34 and flows in a downwardly direction along the free edge of blade 34 to the lowermost region of housing 34 for collection thereat. After removal of the residual material adhering to the photoconductive surface, any residual charge left on the photoconductive surface is extinguished by flooding the photoconductive surface with light from a lamp (not shown).

In order to transfer the next liquid image to the other side of the web of copy paper, web 26 advances to the transfer station of processing unit 60. Processing unit 60, which is substantially identical to processing unit 58, employs a vertically oriented drum 38 having a photoconductive surface deposited on a conductive substrate extending about the circumferential surface thereof. Drum 38 is positioned with its longitudinal axis substantially perpendicular to the horizontal. Thus, the longitudinal axis of drum 38 extends in a direction substantially parallel to the direction of gravity. Drum 38 rotates in the direction of arrow 40 to advance successive portions of the photoconductive surface through the various processing stations disposed about the path of movement thereof. Drum 38 is supported by ball bearings located at the upper and lower ends of its support shaft. A suitable motor associated with a drive is coupled to drum 38 to rotate drum 38 in the direction of arrow 40.

Initially, a portion of the photoconductive surface of drum 38 passes through charging station F. At charging station F, a corona generating device, indicated generally by the reference numeral 42, charges the photoconductive surface of drum 38 to a relatively high, substantially uniform potential. Corona generating device 42 includes a coronode wire and a shield. Both the wire and the shield extend in a direction substantially perpendicular to the horizontal.

Next, the charged portion of the photoconductive surface is advanced through exposure station G. At exposure station G, a raster output scanner 44 lays out an image in a series of vertical scan lines with each line having a specified number of pixels per inch. The raster output scanner 44 includes a laser with a rotating polygon mirror to selectively illuminate the charged portion of the photoconductive surface of drum 38 to record an electrostatic latent image thereon. Thereafter, drum 38 advances the electrostatic latent image recorded on the photoconductive surface of drum 38 to development station H.

At development station H, a developer unit, indicated generally by the reference numeral 46, has a developing liquid comprising a clear insulating carrier liquid and pigmented particles, i.e. black toner particles, stored therein. The developing liquid contacts the electrostatic latent image to form a liquid image on the photoconductive surface of drum 10. Developer unit 46 is mounted on the frame of the printing machine. The developing liquid is circulated by a pump from container through a pipe into development tray from which it is withdrawn through a pipe for recirculation. The tray is elongated and mounted in a vertical orientation on the frame of the printing machine. The longitudinal axis of the tray is substantially perpendicular to the horizontal and substantially parallel to the longitudinal axis of drum 38. When liquid developer material is being circulated, the developer material enters the tray in the uppermost region thereof and flows in a downwardly direction, under the influence of gravity, to the lowermost region of the tray for collection thereat A development electrode, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. Generally, the amount of liquid carrier on the photoconductive surface is too great. A roller whose surface moves in a direction opposite to the direction of movement of the photoconductive surface, is spaced from the photoconductive surface and adapted to shear excessive liquid from the developed image without disturbing the image.

After development, drum 38 advances the liquid image developed on the photoconductive surface thereof to transfer station I. Web of support material 26 advances from transfer station D to transfer station I. Transfer station I includes a corona generating device, indicated generally by the reference numeral 48. Corona generating device 48 includes an elongated shield and a coronode wire. Both the wire and shield extend in a direction substantially perpendicular to the horizontal and substantially parallel to the longitudinal axis of drum 38. Corona generating device 48 sprays ions onto the backside of the web of copy paper 26 to attract the developed image thereto. In this way, a liquid image is formed on other side of the web of copy paper 26. Thereafter, the web of copy paper 26 advances to fusing station J.

Invariably, after transfer, some residual liquid developer material remains adhering to the photoconductive surface of drum 38. This residual developer material is removed from the photoconductive surface at cleaning station K. Cleaning station K includes a cleaning unit, indicated generally by the reference numeral 49, having a cleaning roller mounted rotatably in a housing. The roller is made from a polyurethane material, i.e. a foam, and driven in a direction opposite to the direction of rotation of drum 38 so as to scrub the photoconductive surface clean. A cleaning blade completes the cleaning of the photoconductive surface To assist in this action, liquid carrier may be fed through a pipe onto the cleaning blade. The roller is positioned so that the longitudinal axis thereof is substantially perpendicular to the horizontal and substantially parallel to the longitudinal axis of drum 38. Similarly, the free edge of the blade, which contacts the photoconductive surface of drum 38, extends in a direction substantially perpendicular to the horizontal and substantially parallel to the longitudinal axis of drum 38. In this way, cleaning fluid, i.e. liquid carrier, may be introduced at the uppermost region of the housing and flows in a downwardly direction along the free edge of the blade to the lowermost region of the housing for collection thereat. After removal of the residual material adhering to the photoconductive surface, any residual charge left on the photoconductive surface is extinguished by flooding the photoconductive surface with light from a lamp (not shown).

Fusing station J includes a fusing assembly indicated generally by the reference 50. Fuser assembly 50 includes a pair of heated rollers 52 and 54 which have their longitudinal axes extending in a direction substantially perpendicular to the horizontal and substantially parallel to the longitudinal axis of drum 38. Fuser assembly 50 vaporizes the liquid carrier from the web of copy sheet and permanently fuses the toner particles in image configuration thereto. This forms fused images on opposed sides of the web of copy paper. After fusing, the web of copy paper is advanced to take-up station 56 which cuts the sheets to size and forms stacks thereof for subsequent removal from the printing machine by the operator.

Referring now to FIG. 2, there is shown an isometric view depicting the vertical orientation of processing units 58 and 60 with respect to the direction of gravity, as indicated by the arrow 62. At processing unit 58, the web of copy paper 26 advances into contact with the liquid image formed on the photoconductive surface of drum 10. Corona generating device 30 sprays ions onto the backside of the web of copy paper to transfer the liquid image to one side thereof. Unused liquid developer and residual liquid developer removed from the photoconductive surface of drum 10 descend in a downwardly direction and are collected in housing 64 located beneath drum 10. The collected liquid developer may be reconditioned and recirculated by a liquid management system for subsequent reuse.

Next, web 26 advances to the transfer station at processing unit 60. A liquid image is transferred to the opposite side of the web of copy paper from the photoconductive surface of drum 38. Residual liquid developer and unused liquid developer move in a downwardly direction in cleaning unit 49 and developing unit 46 so as to be collected in housing 66. The liquid management system reconditions and recirculates the residual liquid developer material and unused liquid developer material for subsequent reuse.

After processing unit 60 has transferred the liquid image to the other side of the web of copy paper, web 26 advances through fusing assembly 50. Heated rollers 52 and 54 of fuser assembly 50 vaporize the residual liquid carrier adhering to web 26 and permanently fuse the toner particles thereto in image configuration.

In recapitulation, it is clear that the electrophotographic printing machine of the present invention employs a vertically oriented photoconductive drum having a plurality of vertically oriented processing disposed thereabout to form a liquid image thereon.

It is, therefore, evident that there has been provided in accordance with the present invention, a printing machine that fully satisfies the aims and advantages heretofore mentioned. While this invention has been described in conjunction with a preferred embodiment, it is evident that many alternatives, modifications and variations will be apparent to those skilled in the art. Accordingly, it is intended to embrace all such alternatives, modifications and variations that fall within the spirit and broad scope of the appended claims.

We claim:

1. A printing machine, including:

a drum having a surface adapted to have a latent image recorded thereon, said drum being positioned with the longitudinal axis thereof extending in a direction substantially transverse to the horizontal;

means for developing the latent image with a liquid developer to form a liquid image on the surface of said drum;

means for transferring the liquid image from the surface of said drum to a copy sheet; and means for cleaning the residual liquid developer from the surface of said drum, said cleaning means being positioned so that the residual liquid developer removed from the surface of said drum flows in a downwardly direction under the influence of gravity.

2. A printing machine according to claim 1, wherein said cleaning means includes a roller engaging the surface of said drum to aid in the removal of residual liquid developer therefrom after the transfer of the liquid image from the surface of said drum to the copy sheet, said roller being positioned with the longitudinal axis thereof extending in a direction substantially transverse to the horizontal.

3. A printing machine according to claim 2, wherein said cleaning means includes a cleaning blade having the free edge thereof engaging the surface of said drum to remove the residual liquid developer disturbed by said roller, said cleaning blade having the free edge thereof positioned to extend in a direction substantially transverse to the horizontal.

4. A printing machine according to claim 3, wherein said cleaning means includes means for supplying a cleaning fluid on to the free edge of said cleaning blade to facilitate in the cleaning of the surface of said drum.

5. A printing machine according to claim 4, wherein the longitudinal axis of said developing means extends in a direction substantially transverse to the horizontal.

6. A printing machine according to claim 5, wherein said drum is positioned with the longitudinal axis thereof extending in a direction substantial normal to the horizontal.

7. A printing machine according to claim 6, wherein said roller is positioned with the longitudinal axis thereof extending in a direction substantially normal to the horizontal.

8. A printing machine according to claim 7, wherein said blade is positioned with the free edge thereof extending in a direction substantially normal to the horizontal.

9. A printing machine according to claim 8, further including at least one roller for fusing the liquid image to the copy sheet, said roller being positioned with the longitudinal axis thereof extending in a direction substantially normal to the horizontal.

10. A printing machine according to claim 9, wherein the surface of said drum is made from a photoconductive material.

* * * * *